US006244364B1

(12) United States Patent
Cariveau et al.

(10) Patent No.: US 6,244,364 B1
(45) Date of Patent: Jun. 12, 2001

(54) EARTH-BORING BIT HAVING COBALT/TUNGSTEN CARBIDE INSERTS

(75) Inventors: Peter Cariveau; Robert Slaughter, both of Ponca City, OK (US); Zhigang Fang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/236,147

(22) Filed: Jan. 22, 1999

Related U.S. Application Data

(60) Provisional application No. 60/072,661, filed on Jan. 27, 1998.

(51) Int. Cl.[7] ..... E21B 10/36

(52) U.S. Cl. ..... 175/426; 175/433

(58) Field of Search ..... 175/425, 426, 175/428, 433

(56) References Cited

U.S. PATENT DOCUMENTS

| | | | | |
|---|---|---|---|---|
| 2,774,570 | | 12/1956 | Cunningham | 175/374 |
| 3,442,342 | | 5/1969 | McElya et al. | 175/374 |
| 4,705,124 | | 11/1987 | Abrahamson et al. | 175/410 |
| 4,722,405 | | 2/1988 | Langford, Jr. | 175/426 |
| 4,743,515 | | 5/1988 | Fischer et al. | 428/698 |
| 4,811,801 | | 3/1989 | Salesky et al. | 175/433 |
| 4,820,482 | | 4/1989 | Fischer et al. | 419/15 |
| 4,854,405 | | 8/1989 | Stroud | 175/374 |
| 4,859,543 | | 8/1989 | Greenfield et al. | 428/552 |
| 4,923,512 | | 5/1990 | Timm et al. | 75/239 |
| 5,281,260 | | 1/1994 | Kumar et al. | 75/240 |
| 5,305,840 | | 4/1994 | Liang et al. | 175/426 |
| 5,322,138 | * | 6/1994 | Siracki | 175/374 |
| 5,348,108 | | 9/1994 | Scott et al. | 175/432 |
| 5,467,669 | * | 11/1995 | Stroud | 76/108.2 |
| 5,880,382 | * | 3/1999 | Fang et al. | 75/236 |

* cited by examiner

*Primary Examiner*—David Bagnell
*Assistant Examiner*—Jennifer R. Dougherty
(74) *Attorney, Agent, or Firm*—Rosenthal & Osha L.L.P.

(57) ABSTRACT

An earth-boring device such as a drill bit is disclosed. The earth boring device includes a rotary main cutting structure, an insert on the main cutting structure. The insert is formed of a composition having tungsten carbide and cobalt. The cobalt makes up less than approximately 9% by weight of the composition. The composition has a Rockwell A hardness greater than approximately an $H_{min}$ as determined by the following formula: $H_{min}$=91.1–0.63X, where X represents a cobalt content by weight of the composition.

11 Claims, 3 Drawing Sheets

EARTH-BORING BIT HAVING COBALT/ TUNGSTEN CARBIDE INSERTS

This application claims priority from U.S. Provisional Application 60/072,661 filed on Jan. 27, 1998.

FIELD OF INVENTION

The invention relates to improved earth-boring bits and more particularly to rock bits utilizing tungsten carbide inserts.

BACKGROUND

Earth-boring drill bits are commonly used in drilling oil and gas wells or mineral mines. Typically, an earth-boring drill bit is mounted on the lower end of a drill string. As the drill string is rotated at the surface, the drill bit is rotated down in the borehole as well. With the weight of the drill string bearing down on the drill bit, the rotating drill bit engages an earthen formation and proceeds to form a borehole along a predetermined path toward a target zone.

A rock bit, typically used in drilling oil and gas wells, generally includes one or more rotatable cones that perform their cutting function due to the rolling and sliding movement of the cones acting against the formation. The earth-disintegrating action of the rolling cone cutters is enhanced by a plurality of cutter elements. Cutter elements are generally inserts formed of a very hard material which are press-fitted into undersized apertures or sockets in the cone surface. Due to their toughness and high wear resistance, inserts formed of tungsten carbide in a cobalt binder are commonly used in rock-drilling and earth-cutting applications.

Breakage or wear of tungsten carbide inserts limits the lifetime of a drill bit. In a rock bit, inserts are subjected to high wear loads from contact with a borehole wall. Additionally, the inserts are exposed to high stress due to bending and impacting loads resulting from contact with a borehole bottom. The high wear load can also cause thermal fatigue which initiates surface cracks on the carbide inserts. These cracks are further propagated by a mechanical fatigue mechanism that is caused by the cyclical bending stress and/or impact loads applied to the inserts. The cracks may result in chipping, breakage, and failure of inserts.

Inserts that cut the corner of a borehole bottom generally are subject to the greatest amount of thermal fatigue. Thermal fatigue is caused by heat generation on the gage side of the insert. The heat results from a heavy frictional loading component that is produced as the insert engages the borehole wall and slides to the bottom-most crushing position. When the insert retracts from the bottom, it is quickly cooled by the surrounding circulating drilling fluid. This repetitive heating and cooling cycle can initiate cracking on the outer surface of the insert. These cracks then propagate through the body of the insert when the crest of the insert contacts the borehole bottom. The time required to progress from heat checking to chipping and eventually to a broken insert depends upon the formation type, rotation speed, and applied weight. Despite lower drilling speeds and air cooling, the problem of thermal fatigue is more severe in mining bits because greater weight is applied to the bit and the formations usually are harder. In petroleum bits, thermal fatigue also is a serious concern because of the faster bit rotation speed and cooling with drilling mud.

Cemented tungsten carbide generally refers to tungsten carbide ("WC") particles dispersed in a binder metal matrix (i.e., iron, nickel or cobalt). Tungsten carbide in a cobalt matrix is the most common form of cemented tungsten carbide. This type of tungsten carbide is further classified by grades based on the grain size of WC and the cobalt content. Existing tungsten carbide grades for inserts have been adjusted for desired wear resistance and toughness only. These carbide inserts frequently fail when high rotational speed and high weight are applied due to heat checking and thermal fatigue.

Because thermal fatigue plays a critical role in limiting the lifetime of a tungsten carbide insert and because existing carbide grades are not formulated to minimize thermal fatigue in inserts, there exists an unfulfilled need for inserts formed of an improved tungsten carbide composition which will minimize thermal fatigue while maintaining desired toughness and wear resistance.

SUMMARY OF INVENTION

In some aspects the invention relates to an earth-boring cone, comprising, a rotating surface, a plurality of inserts that extend from the rotating surface, wherein the inserts are formed of a composition comprising tungsten carbide and cobalt, and wherein the composition of the inserts has a minimum Rockwell A hardness as determined by the formula: $H_{min}$=91.1–0.63X, wherein $H_{min}$ is the minimum Rockwell A hardness, and X is the percentage cobalt content by weight.

In an alternative embodiment, the invention relates to an earth-boring cone, comprising, a rotating surface, a plurality of inserts that extend from the rotating surface, and means for increasing thermal fatigue resistance of the inserts without decreasing fracture toughness or wear resistance of the inserts.

In an alternative embodiment, the invention relates to a method of boring an earth formation comprising, providing a rock bit, providing a plurality of cones that are rotatably attached to the rock bit, wherein each cone comprises, a rotating surface, a plurality of inserts that extend from the rotating surface, wherein the inserts are formed of a composition comprising tungsten carbide and cobalt, and wherein the composition of the inserts has a minimum Rockwell A hardness as determined by the formula: $H_{min}$= 91.1–0.63X, wherein $H_{min}$ is the minimum Rockwell A hardness, and X is the percentage cobalt content by weight, placing the cones in contact the earth formation, and rotating the rock bit.

DETAILED DESCRIPTION

Figure 1:
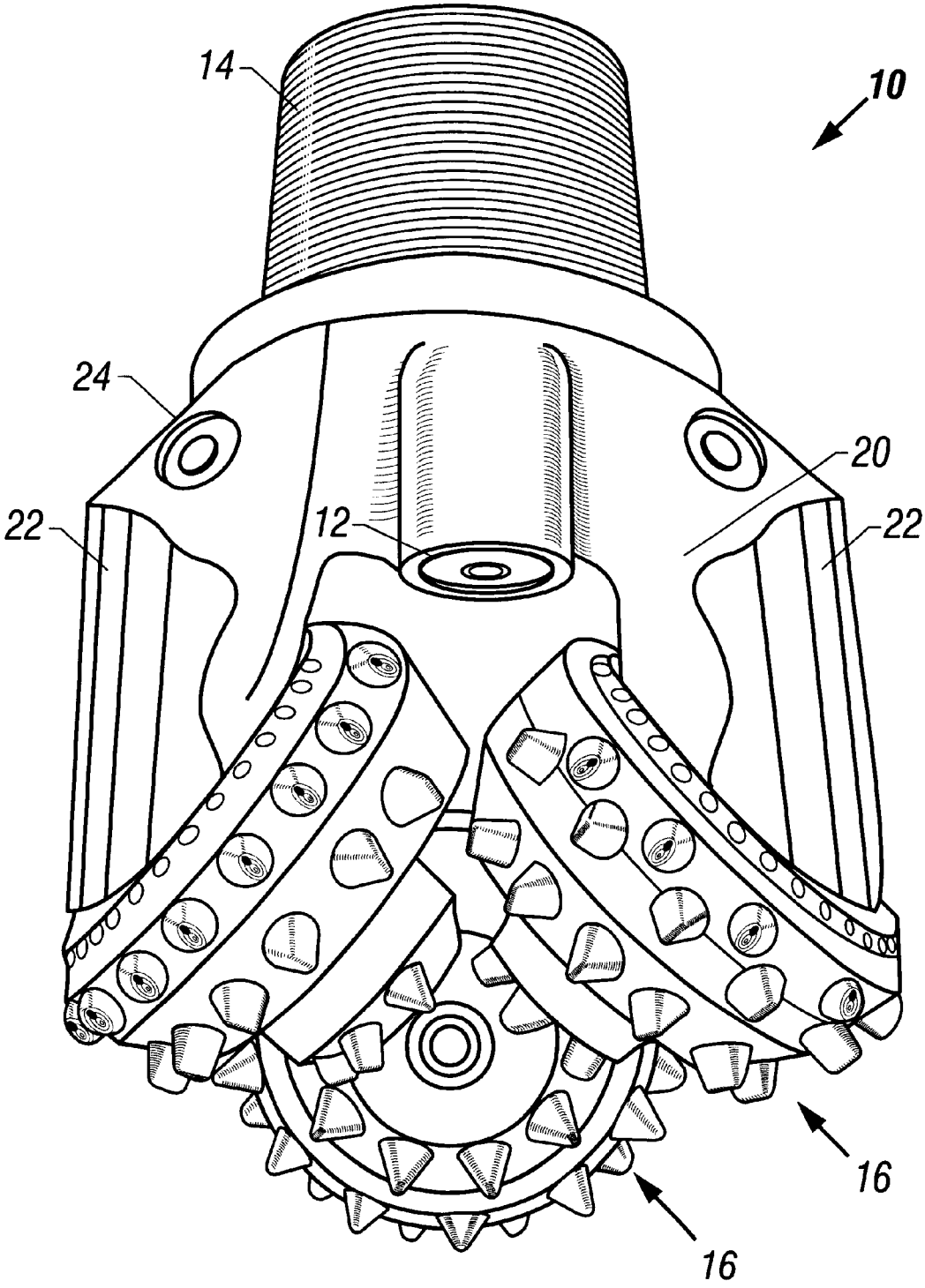
FIG. 1 (Prior Art)
FIG. 1 is a perspective view of a typical earth-boring bit.

Exemplary embodiments of the invention will be described with reference to the accompanying drawings. Like items in the drawings are shown with the same reference numbers.

Embodiments of the invention provide an improved tungsten carbide composition that includes large WC grains with a lower cobalt content. Such an improved tungsten carbide composition minimizes thermal fatigue in tungsten carbide inserts and still maintains desired toughness and wear resistance. Therefore, the improved composition in accordance with embodiments of the invention is suitable for manufacturing inserts used on the main cutting structure of a rock bit.

A typical rock bit is illustrated in FIG. 1. An earth-boring bit 10 generally includes a bit body 20, having a threaded section 14 on its upper end for securing the bit to a drill string (not shown). The bit 10 has three cones 16 rotatably mounted on bearing shafts (hidden) that depend from the bit body 20. The bit body 20 is composed of three legs 22 (two legs are shown in FIG. 1) that are welded together to form bit body 20. The bit 10 further includes a plurality of nozzles 12 that are provided for directing drilling fluid toward the bottom of the borehole and around cones 16. The bit 10 further includes lubricant reservoirs 24 that supply lubricant to the bearings of each of the cutters. It should be understood that mining rock bits can be similarly constructed as described above. This configuration is applicable to mining bits, but typically there is no need for grease reservoirs 24. However, it is foreseeable that mining bits with grease reservoirs will be developed. A person skilled in the art will recognize that embodiments of the invention are suitable for these bits.

Figure 2:
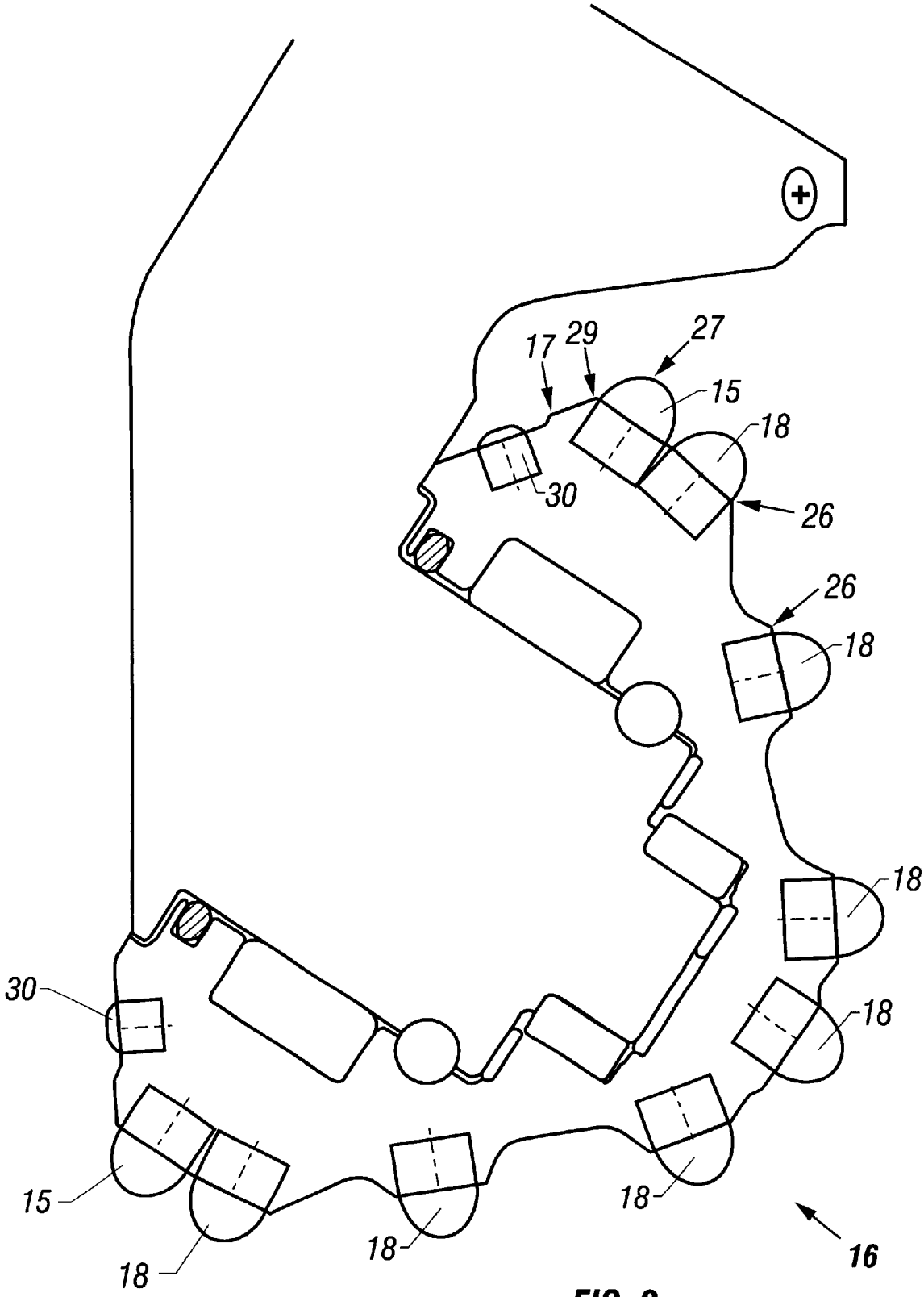
FIG. 2 (Prior Art)
FIG. 2 is a cross-sectional view of a typical rolling cone.

FIG. 2 illustrates a cross-section of a cone 16. The cone 16 generally includes a frustoconical surface 17 and a main cutting structure 32. The frustoconical surface 17, often referred to as the "heel row surface, " is adapted to retain heel row inserts 30 that scrape or ream the sidewall of a borehole as the cone 16 rotates about the borehole bottom. The heel row inserts 30 primarily function to maintain a constant diameter of the sidewall of a borehole. The main cutting structure is defined to include a gage row 27 and inner rows 26. On the gage row 27, a plurality of gage inserts 15 are secured to cone 16 in locations along or near the circumferential shoulder 29. The gage row inserts primarily function to cut the corner of a borehole. This requires the gage row inserts to cut both the sidewall and the bottom of the borehole. On the inner rows 26, the inner row inserts 18 are sized and configured to cut the bottom of the borehole.

In general, the cutting action operating on the borehole bottom typically is a crushing or gouging action. In contrast, the cutting action operating on the sidewall is a scraping or reaming action. Ideally, a crushing or gouging action on the borehole bottom requires a tough insert which is able to withstand high impact and compressive loading. The scraping or reaming action on the sidewall calls for a very hard, wear-resistant insert. Therefore, a hard and wear-resistant material is desirable for heel row inserts, while a tough material is desirable for inserts on the main cutting structure.

For a WC/Co system, it is typically observed that the wear resistance increases as the grain size of tungsten carbide or the cobalt content decreases. However, the fracture toughness decreases as the grain size of tungsten carbide or the cobalt content decreases. Thus, fracture toughness and wear resistance (i.e., hardness) tend to be inversely related: as the grain size or the cobalt content is decreased to improve the wear resistance of a specimen, its fracture toughness will decrease and vice versa. Due to this inverse relationship, it is generally accepted that one grade of cemented tungsten carbide cannot optimally perform both cutting actions because it cannot be as hard as desired for scraping or reaming the sidewall and be as tough as desired for crushing or gouging the bottom. Typically, different tungsten carbide grades have been used for heel row inserts and for inserts on the main cutting structure.

To obtain carbide grades with different toughness and wear resistance, the grain size of tungsten carbide and the cobalt content often are adjusted to obtain desired wear resistance and toughness. Generally, a particular WC grain size is selected to obtain a desired wear resistance. Then the cobalt content is used to adjust the toughness to a desired value. Due to the high wear resistance requirement for heel row inserts, existing carbide grades suitable for heel row inserts are typically limited to WC grains in the range of 2–4 μm and a cobalt content in the range of 6–11%. For example, carbide grades of 2 μm WC/8% Co, 3 μm WC/11% Co and 4 μm WC/6% Co are commonly used for heel row inserts. The relatively small WC grains used in these grades render them highly wear resistant, albeit not very tough.

Figure 3A:
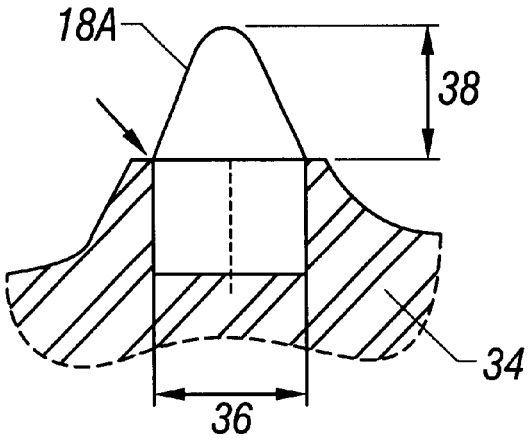
FIGS. 3*a*–3*c* illustrates the definition of "extension-to-diameter ratio" for three different ways of mounting an insert.
Figure 3B:
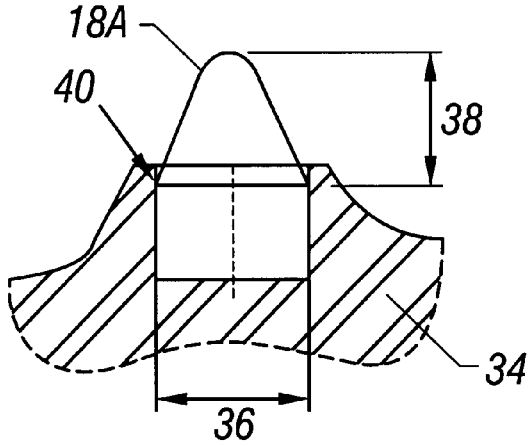
Figure 3C:
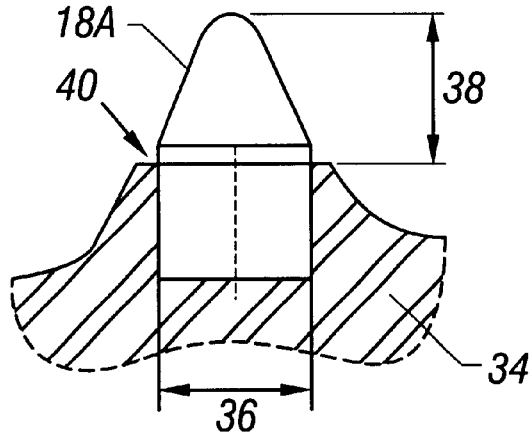

For inserts on the main cutting structure, tougher carbide grades are generally required. Existing grades suitable for such inserts further depend on the extension-to-diameter ratio ("extension ratio") of the inserts. FIGS. 3*a*–3*c* illustrate the definition of extension ratio for an insert 18A, made in accordance with the invention, mounted differently in a cone: the insert is mounted flush to the cone 34 in FIG. 3*a;* the insert is mounted recessed in the cone 34 in FIG. 3*b;* and the insert is mounted protruding from the cone 34 in FIG. 3*c*. In all cases, the extension 38 is measured from bending point 40 to the tip of the insert. An extension ratio is the ratio of extension 38 over diameter 36. In general, a higher extension ratio requires tougher carbide. Furthermore, a tough carbide is preferred due to the crushing and gouging action of the inserts on the main cutting structure. As a result, existing carbide grades used for inserts on the main cutting structure typically are different from those used for heel row inserts.

Existing carbide grades for inserts on the main cutting structure typically are limited to the following ranges: for extension ratios of 50% or more, cobalt contents are 10–16% and grain sizes are 4–6 μm; for extension ratios less than 50%, cobalt contents are 9–14% and grain sizes are 3–5 μm. For example, carbide grades of 3 μm WC/11% Co, 4 μm WC/9% Co, 4 μm WC/11%, 4 μm WC/14% Co and 5 μm WC/10% Co are commonly used for inserts on the main cutting structure with an extension ratio of less than 50%. Carbide grades of 4 μm WC/11% Co, 5 μm WC/10% Co, and 6 μm WC/15% are commonly used for inserts on the main cutting structure with an extension ratio of 50% or more. Although some grades may be used for all extension ratios, other grades may be used only for extension ratios of less than 50%.

While existing tungsten carbide grades are formulated to achieve desired toughness and wear resistance, they are not made to minimize thermal fatigue in tungsten carbide inserts. Efforts to minimize the thermal fatigue in tungsten carbide inserts have led to different formulations such as carbide grades with larger WC grains and a lower cobalt content. The magnitude of thermal fatigue generally depends on a number of physical properties such as thermal fatigue and resistance to thermal shock. Thermal fatigue stress may be expressed in the following equation:

$$\sigma_f = \alpha \cdot E \cdot \Delta T$$

where $\sigma_f$ is thermal fatigue stress, $\alpha$ is coefficient of thermal expansion, E is Young's modulus or elastic modulus, and $\Delta$ T is temperature differential. The thermal shock resistance of a material may be expressed in the following equation:

$$TFR \propto (1-r)\left(\frac{K}{\alpha}\right)\left(\frac{klc}{E}\right)$$

where TFR is thermal fatigue and shock resistance, r is Poisson's ratio, K is thermal conductivity; and klc is fracture toughness.

Thermal fatigue cracks in tungsten carbide/cobalt are believed to be caused by dissimilar thermal properties of tungsten carbide and cobalt. For example, the coefficient of thermal expansion for cobalt is about twice the coefficient of thermal expansion for tungsten carbide. Specifically, the coefficients of thermal expansion for cobalt and tungsten carbide are 13.0–14.0×$10^{-6}$/° C. and 5.0–7.0×10–6/° C., respectively. Additionally, the thermal conductivity of cobalt is approximately half of that of tungsten carbide. Specifically, cobalt has a thermal conductivity of about 0.70 W/cm.sec.° K., whereas tungsten carbide has a thermal conductivity of about 1.3–1.5 W/cm.sec.° K. Because of the large differences in thermal conductivity and coefficient of thermal expansion between tungsten carbide and cobalt, a stress is induced when the composite material is heated and cooled rapidly. Repeated expansion and contraction of the composite material leads to cyclical stress that eventually can form cracks at the weakest point in the composite material. These cracks normally form on the surface of the insert, where temperature fluctuation and matrix distortion are the highest. Damage begins at the surface as a network of cracks develops along the carbide particles. Once these cracks are started, crack growth accelerates rapidly and the insert begins to chip and break.

A carbide grade that uses a reduced amount of cobalt may suffer less thermal damage. Lower cobalt volumes lead to lower distortion at the cobalt/carbide interface and therefore reduce thermally-induced stress. Further, decreasing the cobalt content tends to minimize cobalt depletion or cobalt extrusion, which can be a cause of cobalt erosion during operation. Cobalt erosion also contributes to insert failure. In addition to reducing thermal fatigue stress and cobalt erosion, a lower cobalt content also results in increased thermal conductivity of cemented tungsten carbide. Thermal conductivity of cemented tungsten carbide generally is inversely proportional to the cobalt content. Specifically, as the cobalt content decreases, the thermal conductivity of cemented tungsten carbide increases. Additionally, the coefficient of thermal expansion generally is directly proportional to the cobalt content. As such, when the cobalt content decreases, the thermal fatigue and shock resistance increases significantly because of the increase in the thermal conductivity and the decrease in the coefficient of thermal expansion. This increase in the thermal fatigue and shock resistance is further enhanced by increasing, the grain size of tungsten carbide. The thermal conductivity of cemented tungsten carbide increases as the grain size of tungsten carbide increases. As a result, using larger or coarser tungsten carbide grains results in an increase in the thermal fatigue and shock resistance of cemented tungsten carbide. Another attendant advantage of using tungsten carbide with larger grains is that it increases the toughness of the cemented tungsten carbide. This increase in toughness, by using larger WC rains, offsets the decrease in toughness when the cobalt content is reduced. This is important in that the carbide formulations in accordance with embodiments of the invention improve the thermal fatigue resistance of cemented tungsten carbide without decreasing its toughness.

A person skilled in the art will recognize that the numerical ranges for rain sizes of tungsten carbide are either a nominal number for particle size or an average particle size. In a typical cemented tungsten carbide formulation, the tungsten carbide particles have a size distribution. Therefore, the numerical range for tungsten carbide grain size is only a convenient way to refer to the relative size of tungsten carbide particles in a metal matrix. They are not precisely accurate numbers. However, it is known that Rockwell A hardness correlates to the cobalt content and the tungsten carbide grain size. In fact, a carbide composition or formulation may be defined with a fair degree of precision by cobalt weight percentage and Rockwell A scale hardness. Because both cobalt content and Rockwell A scale hardness can be easily and accurately ascertained, they are the preferred parameters to define embodiments of the invention. Table 1 shows preferred embodiments with respective cobalt content and Rockwell A scale hardness.

TABLE 1

| | Hardness Range (HRa) | |
|---|---|---|
| % Co by Weight | Most Preferred | Preferred |
| 4% | 89.0–93.0 | 88.0–93.0 |
| 5% | 88.0–92.5 | 87.0–92.5 |
| 6% | 87.0–92.0 | 86.0–92.0 |
| 7% | 87.0–91.5 | 86.5–91.5 |
| 8% | 85.0–90.7 | 85.0–90.7 |
| 9% | 85.0–90.5 | 85.0–90.5 |

In some embodiments, it is preferred that a carbide formulation is made to have a hardness greater than a minimum hardness value ($H_{min}$) as determined according to the following formula:

$$H_{min}=91.1-0.63X$$

where $H_{min}$ is a minimal Rockwell A hardness and X is cobalt content by weight. With a given cobalt content, a certain grain size is selected to formulate a tungsten carbide grade to render its hardness greater than the $H_{min}$ for that cobalt content.

In embodiments of the invention, it is preferred that the cobalt content is equal to or less than 9% by weight for extension ratios of less than 50%. For extension ratios of 50% or more, it is preferred that the cobalt content be equal to or less than 10% by weight.

In some embodiments, rock bits are constructed from cones with inserts formed of the above carbide formulations. Rock bits in accordance with embodiments of the invention may be of the type illustrated in FIGS. 1 and 2, except that the inserts on the main cutting structure are formed of the above carbide formulations. Although the geometric shape of the inserts is not critical, it is preferred that they have a semi-round top, a conical top, or a chiseled top.

The following examples illustrate embodiments of the invention and are not restrictive of the invention as otherwise described herein. For the sake of brevity, a carbide formulation according to embodiments of the invention is referred hereinafter as a "thermally-improved grade."

EXAMPLE 1

This example indicates that thermally-improved grade carbides with a lower cobalt content have similar impact strength to conventional grade carbides with a higher cobalt content. To evaluate the toughness of a carbide, the ASTM B771 test was used. It has been found that the American Standard Testing Manual ("ASTM") B771 test, which measures the fracture toughness (klc) of cemented tungsten carbide material, correlates well with the insert breakage resistance in the field.

Briefly, this test method involves application of an opening load to the mouth of a short rod or short bar specimen which contains a chevron-shaped slot. Load versus displacement across the slot at the specimen mouth is recorded autographically. As the load is increased, a crack initiates at the point of the chevron-shaped slot and slowly advances longitudinally, tending to split the specimen in half. The load goes through a smooth maximum when the width of the crack front is about one-third of the specimen diameter (short rod) or breadth (short bar). Thereafter, the load decreases with further crack growth. Two unloading-reloading cycles are performed during the test to measure the effects of any residual microscopic stresses in the specimen. The fracture toughness is calculated from the maximum load in the test and a residual stress parameter which is evaluated from the unloading-reloading cycles on the test record.

Two groups of specimens were prepared according to the standard test method. One group consisted of carbides of conventional grade. The carbide compositions of conventional grade were as follows: 5 μm WC/10% cobalt; 4.5 μm WC/11% cobalt; 4 μm WC/11% cobalt; 4 μm WC/9% cobalt; and 3 μm WC/11% cobalt. The other group consisted of tungsten carbides of thermally-improved grade. The compositions of the thermally-improved grade were as follows: 6 μm WC/8% cobalt; 6 μm WC/6% cobalt; 5 μm WC/8% cobalt; 4 μm WC/9% cobalt; and 4 μm WC/6% cobalt. Three specimens consisting of 6 μm WC/8% cobalt were made, as well as two specimens consisting of 6 μm WC/6% cobalt. Table 2 shows impact strength for each tested specimen.

TABLE 2

| CONVENTIONAL GRADE | | | THERMALLY-IMPROVED GRADE | | |
|---|---|---|---|---|---|
| Grain Size (μm) | Cobalt Volume (%) | Impact Strength | Grain Size (μm) | Cobalt Volume (%) | Impact Strength |
| 5 | 10 | 13.5 | 6 | 8 | 13.0 |
| 4.5 | 11 | 13.5 | 6 | 8 | 13.0 |
| 4 | 11 | 12.4 | 5 | 8 | 12.0 |
| | | | 6 | 6 | 12.1 |
| 4 | 9 | 10.0 | 6 | 6 | 12.1 |
| 3 | 11 | 9.5 | 4 | 6 | 9.3 |
| 3 | 11 | 9.5 | 4 | 9 | 10.0 |

Because impact strength correlates with toughness of a carbide insert in the field, the toughness of the thermally-improved grade carbides may be predicted based on these data. Table 2 shows that the impact strength of a thermally-improved grade using 6 μm grain size WC and 8% cobalt is similar to that of a conventional grade using 5 μm WC and 10% cobalt. Furthermore, the impact strength of a thermally-improved grade using 4 μm WC grains and 6% cobalt is similar to that of a conventional grade using 3 μm WC grains and 11% cobalt. Moreover, the thermally-improved grades of 6 μm WC/6% cobalt and 5 μm WC/8% cobalt have impact strength similar to a conventional grade using 4 μm tungsten carbide grains with 11% cobalt.

EXAMPLE 2

This example shows that carbides of a thermally-improved grade have better wear resistance than ones of a conventional grade with equivalent toughness. Wear resistance can be determined by several ASTM standard test methods. It has been found that the ASTM B611 correlates well with field performance in terms of relative insert wear life time.

The test was conducted in an abrasion wear test machine which had a vessel suitable for holding an abrasive slurry and a wheel made of annealed steel which rotated in the center of the vessel at about 100 RPM. The direction of rotation was from the slurry to the specimen. Four curved vanes were affixed to either side of the wheel to agitate and mix the slurry and to propel it towards a specimen. The testing procedure is briefly described as follows: a test specimen with at least a 3/16-inch thickness and a surface area large enough so that the wear would be confined within its edges was prepared; the specimen was weighed on a balance and its density was determined; the specimen was placed in and fastened to a specimen holder which was inserted into the abrasion wear test machine; a load was applied to the specimen that was bearing against the wheel; aluminum oxide grit of 30 mesh was poured into the vessel and water was added to the aluminum oxide grit; just as the water had seeped into the abrasive grit, the rotation of the wheel was started and it continued for 1,000 revolutions; the rotation of the wheel was stopped after 1,000 revolutions; the sample was then removed from the sample holder, rinsed free of grit and dried; the specimen was weighed again, and the wear number (W) was calculated according to the following formula:

$$W=D/L$$

where D is specimen density and L is weight loss.

Two groups of specimens were prepared: one group consisted of thermally-improved grades; the other group consisted of carbides of a conventional grade. The compositions of thermally-improved grades were as follows: 5 μm WC/8% cobalt; 6 μm WC/8% cobalt; 6 μm WC/6% cobalt; and 4 μm WC/6% cobalt. Compositions of conventional grades were as follows: 5 μm WC/10% cobalt; 4 μm WC/11% cobalt; and 3 μm WC/11% cobalt. Data from the tests according to the ASTM B611 procedure for both groups are summarized in Table 3.

TABLE 3

| CONVENTIONAL GRADE | | | THERMALLY IMPROVED GRADE WITH IMPROVED EQUIVALENT IMPACT STRENGTH TO A CONVENTIONAL GRADE | | |
|---|---|---|---|---|---|
| Grain Size (μm) | Cobalt Volume (%) | B611 Wear Resistance | Grain Size (μm) | Cobalt Volume (%) | B611 Wear Resistance |
| | | | 6 | 8 | 4.5 |
| 5 | 10 | 3.7 | 6 | 8 | 4.5 |
| 4 | 11 | 4.0 | 5 | 8 | 4.0 |
| | | | 6 | 6 | 4.9 |
| 3 | 11 | 6.1 | 4 | 6 | 10.0 |

The data in Table 3 indicate that a thermally-improved grade has equivalent or better wear resistance than a conventional grade having equivalent toughness. Specifically, according to Table 2, a thermally-improved grade of 6 μm WC/8% cobalt has similar toughness to a conventional grade with 5 μm WC/10% cobalt. According to Table 3, the thermally-improved grade using 6 μm WC/8% cobalt has better wear resistance than its equivalent (i.e., a conventional grade using 5 μm WC/10% cobalt). Surprisingly, the thermally-improved grade using 4 μm WC/6% cobalt has far better wear resistance than the conventional grade using 3 μm WC/11% cobalt, although they have comparable toughness. Similarly, the thermally-improved grade of 6 μm WC/6% cobalt is more wear resistant than the conventional grade of 4 μm WC/11% cobalt. These data clearly support that reducing cobalt contents in tungsten carbide and simultaneously increasing tungsten carbide grain sizes result in better wear resistance while still maintaining the desired toughness. As explained above, such compositions also minimize thermal fatigue in tungsten carbide inserts made from these compositions. Therefore, it is possible to manufacture a thermally-improved tungsten carbide grade which has equivalent or better wear resistance without sacrificing the required toughness.

EXAMPLE 3

This example indicates that carbides of a thermally-improved grade have higher hardness than ones of a conventional grade with similar toughness. Hardness is determined by the Rockwell A scale. It is known that hardness correlates with wear resistance.

Table 4 summarizes the testing results. Samples of conventional grades and thermally-improved grades were tested according to the standard procedure. It is noted that carbide with 5 μm WC/8% cobalt has hardness similar to a conventional grade with 4 μm WC/11% cobalt. These two kinds of carbide have similar impact strength. This is also true for a thermally-improved grade with 6 μm WC/6% cobalt. On the other hand, a thermally-improved grade of 4 μm WC/6% cobalt has a higher hardness than its equivalent conventional grade (i.e., 3 μm WC/11% cobalt). Similarly, a thermally-improved grade using 6 μm WC/8% cobalt is harder than a conventional grade with 5 μm WC/10% cobalt, although they have similar impact strength.

These data further support that reducing cobalt contents in cemented tungsten carbide and simultaneously increasing tungsten carbide grain size result in higher hardness while maintaining the desired toughness. Therefore, it is possible to manufacture a thermally-improved tungsten carbide grade that has better wear resistance without sacrificing the required toughness.

TABLE 4

| CONVENTIONAL GRADE | | | THERMALLY IMPROVED GRADE | | |
|---|---|---|---|---|---|
| Grain Size (μm) | Cobalt Volume (%) | Rockwell A Hardness | Grain Size (μm) | Cobalt Volume (%) | Rockwell A Hardness |
| 4.0 | 11 | 88.4–89.2 | 5 | 8 | 88.3–89.1 |
| | | | 6 | 6 | 88.6–89.4 |
| 3.0 | 11 | 89.0–89.9 | 4 | 6 | 90.4–91.2 |
| 5.0 | 10 | 87.7–88.5 | 6 | 8 | 88.2–89.0 |
| 4.0 | 10 | 88.6–89.6 | 5 | 8 | 88.3–89.1 |
| | | | 6 | 6 | 88.3–89.4 |

To compare the performance of a thermally-improved grade and a conventional grade, field tests were conducted with respect to rock bits using inserts formed of the following thermally-improved grades: 4 μm WC/6% cobalt (the "406 grade"); 4 μm WC/9% cobalt (the "409 grade"); 6 μm WC/6% cobalt (the "606 grade"); and 6 μm WC/8% cobalt (the "608 grade"). These thermally improved grades are compared with the following conventional grades: 3 μm WC/11% cobalt (the "311 grade"); and 5 μm WC/10% Co (the "510 grade"). A bit size of 7⅞ inches was used for the 406 grade, whereas a bit size of 12¼ inches was used for the 409, 606 and 608 grades.

EXAMPLE 4

This example shows that the 406 grade resulted in about a 60% increase in total rock bit life with no loss in drilling efficiency. A 7⅞" diameter three-cone rotary rock bit was constructed using the 311 conventional grade for drill medium hardness formations. The rock formation being drilled consisted of compacted sandstone with large grain nodules. This rock bit achieved an average life of 40 hours and produced 5200 feet of drilling distance. The bit exhibited a dull condition with severe wear on all gage inserts. Consequently, the drill bit was discarded.

In contrast, a series of five test bits using the 406 thermally-improved grade in the gage inserts were run at the same location. The bits achieved a median life of about 63 hours and a drilling distance of about 8200 feet. This was approximately a 60% increase in total rock bit life without a decrease in drilling efficiency.

EXAMPLE 5

This example shows that the 608 grade achieved about a 10% reduction in volume loss over a conventional grade in a split cone test. In a split cone test, each rolling cone was fitted with a conventional grade in half of the gage inserts and a thermally-improved grade in the other half. In this example, the conventional grade was the 510 grade, and the thermally-improved grade was the 608 grade. A small indicator insert was placed on each rolling cone where the carbide grades were alternated.

A rock bit using these split cones was tested in a mine in Tucson, Ariz., which contained an abrasive ore with quartzite and pyrite deposits. In this type of formation, a medium formation drill bit achieves a median life of about 55 hours and a drilling distance of 3500 feet. Primary carbide wear failures at this mine are mainly attributed to material loss on the gage row inserts. This rock bit achieved an average life of 40 hours and produced 5200 feet of drilling distance. After the bit was run to the median life of a standard assembly, the bit was examined for gage row insert wear. The 608 grade exhibited a visible reduction in volume loss of about 10% over the 510 grade. Furthermore, the 608 grade showed very little chipping and very few heat-checking cracks. There were indications that the 510 grade would have continued to wear and eventually break gage inserts due to heat-checking cracks if the tests had continued.

EXAMPLE 6

This example demonstrates that the 606 grade resulted in visibly significant decrease in volume loss of about 20% compared to the 510 grade. A split cone was prepared using a 606 grade and a 510 grade in the gage row inserts. Rock bits incorporating such split cones were tested in a copper mine which included an abrasive ore with quartzite and pyrite deposits. This formation is softer than the formation tested in Example 5. In this formation, the median bit life is about 80 hours and the median drilling distance is about 13,500 feet. The test bit was run for the median hours and examined for volume loss on gage inserts. It was observed that the 606 grade resulted in a 20% reduction in volume loss as compared to the 510 grade.

EXAMPLE 7

A split cone was also prepared using a 409 grade and a 510 grade and tested in the same method as in Example 5. It was observed that the 409 grade achieved a visible reduction in volume loss of about 20%. Further, there were fewer large heat-checking cracks, and the overall insert condition was improved.

As demonstrated above, thermally-improved carbide formulations using larger WC grains and a lower cobalt content may have many advantages, including improved wear resistance while maintaining the required toughness. Tungsten carbide inserts formed of such formulations experience reduced thermal fatigue, thereby increasing the lifetime of rock bits which incorporate such inserts.

While the invention has been disclosed with respect to a limited number of embodiments, those skilled in the art will appreciate numerous modifications and variations therefrom. For example, carbide materials suitable for use in embodiments of the invention may be selected from compounds of carbide and metals selected from groups IVB, VB, VIB, and VIIB of the Periodic Table of the elements. Examples of such carbides include tantalum carbide and chromium carbide. Binder matrix materials suitable for use in the invention include the transition metals of group VIII of the Periodic Table of the elements. For example, iron and nickel are also good binder matrix materials. Although embodiments of the invention are illustrated with respect to tungsten carbide inserts in a rock bit, the improved carbide formulations may also be used to form cutting elements in raise bore and shaft drill cutters. It should be understood that a rock bit or an earth-boring bit using three cutter cones is a preferred embodiment. The invention may be practiced with any number of cutter cones. It is intended that the appended claims cover all such modifications and variations as fall within the true spirit and scope of the invention.

While the invention has been disclosed with reference to specific examples of embodiments, numerous variations and modifications are possible. Therefore, it is intended that the invention not be limited by the description in the specification, but rather the claims that follow.

What is claimed is:

1. An earth-boring device comprising:

a rotary main cutting structure; and an insert on the main cutting structure, the insert being formed of a composition having tungsten carbide and cobalt, the tungsten carbide having an average grain size of at least 4 micrometers, the cobalt being less than approximately 9% by weight of the composition, the composition having a Rockwell A hardness greater than approximately an $H_{min}$ as determined by the following formula: $H_{min}$=91.1−0.63X, wherein X is a cobalt content by weight.

2. The earth-boring device as defined in claim 1 wherein the insert comprises an extension ratio of at least 50 percent.

3. An earth-boring device comprising:

a rotary main cutting structure; and an insert having an extension ratio of at least 50% disposed on the main cutting structure, the insert being formed of a composition having tungsten carbide and cobalt, the tungsten carbide having an average grain size of at least 4 micrometers, the cobalt being greater than approximately 9% but less than approximately 10% by weight of the composition, the composition having a Rockwell A hardness greater than approximately an $H_{min}$ as determined by the following formula: $H_{min}$=91.1−0.63X, wherein X is a cobalt content by weight.

4. An insert for use as a cutting element on a main cutting structure of an earth-boring device, the insert having an extension ratio of at least 50 percent, comprising:

a composition having tungsten carbide and cobalt, the tungsten carbide having an average grain size of at least 4 micrometers, the cobalt being greater than approximately 9% but less than approximately 10% by weight of the composition, the composition having a Rockwell A hardness greater than approximately an $H_{min}$ as determined by the following formula: $H_{min}$=91.1−0.63X, wherein X is a cobalt content by weight.

5. A method for boring an earth formation, comprising:

using an earth-boring device, wherein the earth-boring device includes: a rotary main cutting structure; and an insert on the main cutting structure, the insert being formed of a composition having tungsten carbide and cobalt, the tungsten carbide having an average grain size of at least 4 micrometers, the cobalt being less than approximately 9% by weight of the composition, the composition having a Rockwell A hardness greater than approximately an $H_{min}$ as determined by the following formula: $H_{min}$=91.1−0.63X, wherein X is a cobalt content by weight.

6. The method as defined in claim 5 wherein the insert comprises an extension ratio of at least 50 percent.

7. A method for boring an earth formation, comprising:

using an earth-boring device, wherein the earth-boring device includes: a rotary main cutting structure; and an insert disposed on the main cutting structure, the insert being formed of a composition having tungsten carbide and cobalt, the tungsten carbide having an average grain size of at least 4 micrometers, the cobalt being greater than approximately 9% but less than approximately 10% by weight of the composition, the composition having a Rockwell A hardness greater than approximately an $H_{min}$ as determined by the following formula: $H_{min}$=91.1−0.63X, wherein X is a cobalt content by weight.

8. The method as defined in claim 7 wherein the insert comprises an extension ratio of at least 50 percent.

9. An earth-boring device comprising:

a rotary main cutting structure; and an insert on the main cutting structure, the insert being formed of a composition having tungsten carbide and cobalt, the cobalt being greater than approximately 6% by weight and less than approximately 9% by weight of the composition, the composition having a Rockwell A hardness greater than approximately an $H_{min}$ as determined by the following formula: $H_{min}$=91.1−0.63X, wherein X is a cobalt content by weight, and wherein the insert is formed so that the composition is in contact with earth formations during drilling thereof.

10. An earth-boring device comprising:

a rotary main cutting structure; and an insert having an extension ratio of at least 50% disposed on the main cutting structure, the insert being formed of a composition having tungsten carbide and cobalt, the cobalt being greater than approximately 9% but less than approximately 10% by weight of the composition, the composition having a Rockwell A hardness greater than approximately an $H_{min}$ as determined by the following formula: $H_{min}$=91.1−0.63X, wherein X is a cobalt content by weight, and wherein the insert is formed so that the composition is in contact with earth formations during drilling thereof.

11. An insert for use on the main cutting structure of a roller cone forming pat of a roller cone drill bit, the insert comprising:

a composition having tungsten carbide and cobalt, the cobalt being greater than approximately 6% by weight and less than approximately 9% by weight of the composition, the composition having a Rockwell A hardness greater than approximately an $H_{min}$ as determined by the following formula: $H_{min}$=91.1−0.63X, wherein X is a cobalt content by weight, and wherein the insert is formed so that the composition is in contact with earth formations during drilling thereof.

* * * * *